United States Patent [19]

Sloan

[11] 4,281,998

[45] Aug. 4, 1981

[54] SOLVENT-RESISTANT ALKYLATED MELAMINE CROSS-LINKED CELLULOSE ESTER ARTICLES

[75] Inventor: Cephas H. Sloan, Kingsport, Tenn.

[73] Assignee: Eastman Kodak Company, Rochester, N.Y.

[21] Appl. No.: 117,918

[22] Filed: Feb. 4, 1980

[51] Int. Cl.[3] ..... D06M 1/00

[52] U.S. Cl. ..... 8/129; 260/15; 57/243; 536/80

[58] Field of Search ..... 260/15; 427/389.9; 8/129; 536/80; 57/243

[56] References Cited

U.S. PATENT DOCUMENTS

| | | | |
|---|---|---|---|
| 3,491,037 | 1/1970 | Keys et al. | 260/15 |
| 3,811,131 | 5/1974 | Gamarra et al. | 8/129 |
| 3,839,528 | 10/1974 | Turbak et al. | 260/15 |
| 4,120,836 | 10/1978 | Averbach | 260/15 |

*Primary Examiner*—Earl A. Nielsen

*Attorney, Agent, or Firm*—John F. Stevens; Daniel B. Reece, III

[57] ABSTRACT

A process is disclosed for treating cellulose ester articles which comprises applying to the surface of the articles a solution of alkylated melamine such as hexamethoxymethylmelamine and an acid catalyst. The solution is applied such as to result in a deposit of alkylated melamine in an amount of between about 1% and about 10% based on the weight of the cellulose ester article and acid in an amount of from about 0.01 to about 1.0% based on the weight of the cellulose ester article. The article is then heated to cause a reaction to occur between the alkylated melamine and the surface of the cellulose ester article to form a crosslinked skin to render the article resistant to attack by solvents.

10 Claims, No Drawings

SOLVENT-RESISTANT ALKYLATED MELAMINE CROSS-LINKED CELLULOSE ESTER ARTICLES

FIELD OF THE INVENTION

This invention relates to the treatment of cellulose ester fibers or filaments to cause surface crosslinking, thereby rendering them resistant to conventional solvents.

DESCRIPTION OF THE INVENTION

U.S. Pat. No. 3,491,037 discloses that the overall quality and properties of cellulose ester fibers or filaments can be vastly improved without incurring a severe loss in tensile properties. This improved fiber is produced by adding hexamethoxymethylmelamine along with a special "neutral" or "blocked" catalyst to a regular cellulose ester spinning solution. The spinning solution is spun by conventional dry spinning techniques to produce a fiber which is then heated to cause the catalyst to become acidic. The acidic catalyst thus formed causes the hexamethoxymethylmelamine to react with the cellulose ester thereby forming a modified fiber having superior physical and chemical properties.

This patent also discloses that it is well known that certain synthetic linear condensation polyesters of the cellulose ester class are generally very good fiber forming compositions. However, they are subject to certain inherent disabilities which greatly restrict their utility as general purpose fibers. For example, these cellulose esters and the fibers prepared therefrom do not have a very high elastic recovery capability and are quite susceptible to heat, moisture and photodegradation. In the past many attempts have been made to find some method or means whereby these inherent disabilities of fibers made from cellulose esters could be improved. Means of achieving this goal have usually centered around the addition of an inert or chemically active additive material to either (1) the solution from which the fibers are spun, or (2) to the fibers after they have been woven. The use of additives in the spinning solution has generally been unacceptable, since it usually results in a severe reduction in or complete loss of certain desirable physical properties such as, for example, the tensile strength of the fibers.

In contrast with the teachings of U.S. Pat. No. 3,491,037, the fibers or filaments of cellulose ester material according to the present invention are subjected to a treatment which causes crosslinking only at the skin or surface thereof. Thus, the solution is not contaminated by the treatment, and much less of the treatment material is required.

SUMMARY OF THE INVENTION

According to the present invention, a process for treating a cellulose ester article (e.g., fibers and filaments or bundles thereof) is provided which comprises applying to the surface of the article a solution of alkylated melamine such as hexamethoxymethylmelamine and an acid catalyst. The solution is applied such as to result in a deposit of alkylated melamine in an amount of between about 1% and about 10% based on the weight of the cellulose ester article and the acid in an amount of from about 0.01 to about 1.0% based on the weight of the cellulose ester article. The solution is then heated to cause a reaction to occur between the alkylated melamine and the surface of the cellulose ester article to form a crosslinked skin.

DETAILED DESCRIPTION OF THE INVENTION

According to the present invention, a method of treating cellulose ester fibers to render them insoluble in conventional solvents (e.g., acetone) while still bondable to form articles of manufacture (e.g., bundles of fibers formed into rods useful as filters) is provided. The treatment of the fibers results in the cellulose ester being crosslinked at the surface of the fibers only, which has been found to render the fibers resistant to conventional solvents. The invention differs from that disclosed in U.S. Pat. No. 3,491,037 in that, since the crosslinking agent is not added to the spinning dope, there is no contamination of the acetone dope solvent and, since only the surfaces of the fibers are treated, less crosslinking agent is required.

The surface or skin crosslinking treatment of the fibers is accomplished by applying to the surfaces thereof a solution containing the crosslinking agent and catalyst, followed by the application of heat for a period of at least 5 minutes at temperatures of at least 140° C. and preferably about 160° C.

The crosslinking agent used in the present invention is an alkylated melamine, which is preferably, and is hereinafter referred to as hexamethoxymethylmelamine, which has been known for some time and its use as a protective coating for various materials has been investigated quite extensively.

Hexamethoxymethylmelamine, which has the following formula:

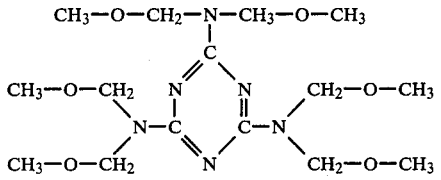

is available commercially under the trade name Cymel 300 from American Cyanamid Company. Others include highly alkylated melamine such as Cymel 301, 303, 1116, 1130 and 1156. Partially alkylated melamines include Cymel 370, 373, 380 and 350.

Hexamethoxymethylmelamine is somewhat reactive by itself, but its reactivity should usually be increased and modified by a substantial amount. It is found that one way in which the reactivity of hexamethoxymethylmelamine with cellulose esters can be improved is by lowering the pH of the system.

Although p-toluene sulfonic acid is preferred as the base acid from which the catalyst is to be formed it should be realized that other such acids could be used. Examples of other acids which can be used are: phenyl acid phosphate, citric acid, butyl acid phosphate, oxalic acid, benzene sulfonic and monobutyl acid maleate.

Any conventional volatile solvents or combination of solvents may be used to dissolve and carry the crosslinking agent and acid catalyst. It has been found, however, that a combination of water and a lower alcohol ($C_2$–$C_4$) such as methanol or ethanol is very suitable. Other useful additives in the solution include conventional surfactants such as Triton X100, an alkylaryl polyether alcohol. Typical solutions to result in the amounts of deposits of alkylated melamine would be as follows:

| | Preferred Range, Wt. % | Broad Range, Wt. % |
|---|---|---|
| Water | about 44 | 30–45% |
| Alcohol | about 50 | 50–65% |
| Crosslinking Agent | about 6.0 | 2–10% |
| Acid Catalyst | about 0.1 | 0.01–1.0% |

Cellulose ester spinning solutions are commonly made by dissolving the cellulose ester in a solvent. For example, cellulose acetate may be dissolved in acetone and the solution can easily be spun by extruding it into an atmosphere of inert gas, which may be heated, where the motion of the inert gaseous atmosphere, the extruded fiber and the application of heat all aid in disposing of the volatile solvent in the solution. A solution of the crosslinking agent and catalyst may then be applied to the fiber thereby leaving a fiber of cellulose ester having on its surface hexamethoxymethylmelamine and catalyst in a substantially unreacted or free state. However, once the fiber is subjected to a heat treatment step the hexamethoxymethylmelamine reacts to form skin on the cellulose ester fiber having superior chemical and physical properties such as solvent resistance.

The solution may conveniently be applied to cellulose ester fibers, or bundles of fibers, after they are formed from a spinning solution by conventional methods such as spraying, dipping, wiping, rolling, etc. One preferred manner of applying the solution is by mixing it with a bonding agent (usually a plasticizer) which is conventionally applied to a bundle of fibers to adhere them together. Thereafter, heat of at least 140° C. and preferably about 160° C. is applied for a time of at least 2 to 5 minutes, preferably about 5 minutes.

The amount of heat is limited to about 160° C. to prevent degradation of the cellulose ester. The heat, however, is sufficient to cause a crosslinking reaction between the cellulose ester and the crosslinking agent at the skin or surface of the fibers. By skin or surface it is meant at least the outermost molecular layer of the fiber.

The following examples are submitted for a better understanding of the invention.

EXAMPLE 1

A 15 in. segment of 3.3 denier per filament, 44,000 total denier cellulose acetate tow weighing 5 grams is immersed in a methanol solution containing 10% (by wt.) of Cymel 303 (a highly alkylated melamine manufactured by American Cyanamide) and 0.1% p-toluene sulfonic acid catalyst. The excess solution is removed from the two by compression and the two segment is then allowed to air-dry. The tow is then weighed and based on the weight increase, it is calculated to contain 5.7% Cymel 303 and 0.11% catalyst (p-toluene sulfonic acid). A 10-inch section of the tow is bloomed and sprayed with 8% glyceryl triacetate (which dissolves the surfaces of the fibers and allows them to bond) and then drawn into a hollow tube to form a bonded rod. After about a 2-hour curing period, the bonded rod is heated at 160° C. for 5 min. The rod is then immersed in acetone to test its resistance to solvent action. No dissolution or deformation of the rod occurs indicating the acetate has been crosslinked.

EXAMPLE 2

A 15-inch segment of segment of 3.3 den./fil., 44,000 total denier cellulose acetate two weighing 5 grams is immersed in a methanol solution containing 3% Cymel 303 and 0.1% p-toluene sulfonic acid catalyst. The excess solution is removed by compressing the two and then allowing it to air dry. When dry, the tow is weighed again and was found to contain 2.9% Cymel 303 and 0.1% catalyst. A 10-inch section of the tow is bloomed and sprayed with about 9% glyceryl triacetate, drawn into a hollow tube and allowed to bond. The bonded rod is heated 5 min. at 160° C. to cause crosslinking. The rod is then immersed in acetone to test its resistance to solvent action. The acetate is unaffected by the acetone indicating crosslinking had occurred.

EXAMPLE 3

Example 1 is repeated except that the solvent for the crosslinking agent is composed of 60% ethanol and 40% water. Acetate fibers treated in the water-ethanol solution have solvent resistant properties equally as good as those treated with the methanolic crosslinking solution.

EXAMPLE 4

Example 1 is repeated except that the crosslinking agent is Cymel 370 (a partially methylated melamine manufactured by American Cyanamid Company) instead of Cymel 303. The acetate fibers treated in this crosslinking agent are completely resistant to the effects of acetone.

EXAMPLE 5

Example 2 is repeated except that Cymel 370 partially alkylated melamine is used instead of Cymel 303 as the crosslinking agent. The treated fibers are resistant to solvation by acetone, thus indicating that crosslinking of the acetate has occurred.

Unless otherwise indicated, all parts, percentages, ratios, etc., are by weight.

The invention has been described in detail with particular reference to preferred embodiments thereof, but it will be understood that variations and modifications can be effected within the spirit and scope of the invention.

I claim:

1. Process for treating a cellulose ester article which comprises applying to the surface of said article a solution of an alkylated melamine wherein each of the alkyl groups contain from 1 to 4 carbon atoms and an acid catalyst, said solution being at a concentration and applied in an amount such as to result in a deposit of alkylated melamine in an amount of between about 1% and about 10% based on the weight of the cellulose ester article and said acid catalyst in an amount of from about 0.01 to about 1.0% based on the weight of the cellulose ester article, and applying heat to said article thereby causing a reaction to occur between the alkylated melamine and the surface of the cellulose ester article to form a crosslinked skin.

2. Process according to claim 1 wherein the alkylated melamine is applied in an amount of between about 4 and about 6 percent based on the total weight of the article.

3. Process according to claim 1 wherein the alkylated melamine is hexamethoxymethylmelamine.

4. Process according to claim 1 wherein said solution comprises a minor amount of water and a major amount of an alcohol having 1 to 4 carbon atoms.

5. Process according to claim 1 wherein the cellulose ester is cellulose acetate.

6. Process according to claim 1 wherein the heat applied to said article reaches a temperature of at least 140° C. for a period of at least 5 minutes.

7. Process for treating cellulose acetate fibers which comprises applying to the surface of the fibers a solution of hexamethoxymethylmelamine in water and alcohol and an acid catalyst, said solution being at a concentration and applied in an amount such as to result in a deposit of hexamethoxymethylmelamine in an amount of between about 4% and about 6% based on the weight of the cellulose ester fibers and acid catalyst in an amount of from about 0.01 to about 1.0% based on the weight of the cellulose ester fibers, and applying heat to said fibers so that a reaction occurs between the hexamethoxymethylmelamine and the surface of the cellulose acetate fibers to form a crosslinked skin.

8. A cellulose ester fiber characterized in that the cellulose ester molecules at the surface thereof are crosslinked by an alkylated melamine crosslinking agent and the molecules of the core of the fiber are in an essentially non-crosslinked condition, said fiber being resistant to attack by conventional solvents.

9. A fiber according to claim 7 wherein the crosslinking agent is hexamethoxymethylmelamine.

10. An article of manufacture comprising a multiplicity of fibers according to claim 8.

* * * * *